US008244585B1

(12) United States Patent
Huang et al.

(10) Patent No.: US 8,244,585 B1
(45) Date of Patent: Aug. 14, 2012

(54) OPTIMIZED BIDDING FOR PAY-PER-CLICK LISTINGS

(75) Inventors: Jian Huang, Woburn, MA (US); Yankang Jiang, Winchester, MA (US); Qi Gu, Burlington, MA (US)

(73) Assignee: SuperMedia LLC, DFW Airport, TX (US)

( * ) Notice: Subject to any disclaimer, the term of this patent is extended or adjusted under 35 U.S.C. 154(b) by 1218 days.

(21) Appl. No.: 12/031,124

(22) Filed: Feb. 14, 2008

Related U.S. Application Data

(60) Provisional application No. 60/889,874, filed on Feb. 14, 2007, provisional application No. 60/889,830, filed on Feb. 14, 2007, provisional application No. 60/889,828, filed on Feb. 14, 2007.

(51) Int. Cl.
*G06Q 30/00* (2012.01)

(52) U.S. Cl. ..... 705/14.41; 705/14.72

(58) Field of Classification Search ..... None
See application file for complete search history.

(56) References Cited

U.S. PATENT DOCUMENTS

| | | | | |
|---|---|---|---|---|
| 7,089,195 | B2 * | 8/2006 | Rosenberg | 705/14.69 |
| 7,181,438 | B1 | 2/2007 | Szabo | |
| 2003/0033292 | A1 | 2/2003 | Meisel et al. | |
| 2003/0149937 | A1 * | 8/2003 | McElfresh et al. | 715/517 |
| 2005/0076014 | A1 * | 4/2005 | Agarwal et al. | 707/3 |
| 2005/0080772 | A1 * | 4/2005 | Bem | 707/3 |
| 2005/0097024 | A1 * | 5/2005 | Rainey | 705/37 |
| 2005/0097204 | A1 * | 5/2005 | Horowitz et al. | 709/223 |
| 2005/0144069 | A1 * | 6/2005 | Wiseman et al. | 705/14 |
| 2005/0154717 | A1 * | 7/2005 | Watson et al. | 707/3 |
| 2007/0027850 | A1 * | 2/2007 | Chan et al. | 707/3 |
| 2007/0060099 | A1 * | 3/2007 | Ramer et al. | 455/405 |
| 2007/0060173 | A1 * | 3/2007 | Ramer et al. | 455/456.3 |
| 2007/0078707 | A1 * | 4/2007 | Axe et al. | 705/14 |
| 2007/0100806 | A1 * | 5/2007 | Ramer et al. | 707/3 |
| 2007/0130014 | A1 * | 6/2007 | Altberg et al. | 705/14 |
| 2007/0260635 | A1 * | 11/2007 | Ramer et al. | 707/104.1 |
| 2008/0010142 | A1 * | 1/2008 | O'Brien et al. | 705/14 |

OTHER PUBLICATIONS

Reply Brief dated Jun. 13, 2011 in U.S. Appl. No. 12/031,098 (7 pages).
Reply Brief dated May 18, 2011 in U.S. Appl. No. 12/031,028 (7 pages).
Non-Final Office Action dated May 12, 2010 in U.S. Appl. No. 12/031,098 (20 pages).
Response to Non-Final Office Action dated May 12, 2010 in U.S. Appl. No. 12/031,098 (17 pages).
Final Office Action dated Oct. 21, 2010 in U.S. Appl. No. 12/031,098 (25 pages).
Interview Summary dated Nov. 12, 2010 in U.S. Appl. No. 12/031,098 (3 pages).

(Continued)

*Primary Examiner* — Jonathan G Sterrett
*Assistant Examiner* — Stephen S Swartz
(74) *Attorney, Agent, or Firm* — Rader, Fishman & Grauer PLLC

(57) ABSTRACT

A plurality of pay-per-click listings is retrieved based on a search query. For each pay-per-click listing, a rank value is calculated that is based at least in part on a performance score and a maximum bid, thereby generating a calculated rank value. The plurality of pay-per-click listings is ordered based at least in part on the calculated rank value. A cost is determined associated with each of the plurality of pay-per-click listings.

19 Claims, 4 Drawing Sheets

OTHER PUBLICATIONS

Appeal Brief dated Jan. 26, 2011 in U.S. Appl. No. 12/031,098 (25 pages).
Examiner's Answer dated Apr. 15, 2011 in U.S. Appl. No. 12/031,098 (31 pages).
Non-Final Office Action dated May 12, 2010 in U.S. Appl. No. 12/031,028 (27 pages).
Response to Non-Final Office Action dated May 12, 2010 in U.S. Appl. No. 12/031,028 (17 pages).
Final Office Action dated Oct. 14, 2010 in U.S. Appl. No. 12/031,028 (27 pages).
Interview Summary dated Nov. 10, 2010 in U.S. Appl. No. 12/031,028 (3 pages).
Appeal Brief dated Jan. 26, 2011 in U.S. Appl. No. 12/031,028 (23 pages).
Examiner's Answer dated Apr. 1, 2011 in U.S. Appl. No. 12/031,028 (37 pages).

* cited by examiner

Listings 125

| Id | Advertiser | Campaign ID | Category | Description | Full Text | Keywords | Date Added | Hyperlink |
|---|---|---|---|---|---|---|---|---|
| 1 | Company1 | 1 | Restaurants | Justin's Deli | Check o… | food, deli | 1/7/2004 | http://ww. |
| 2 | Company1 | 34 | Restaurants | Pizza Place | Be sure… | pizza, food | 2/5/2005 | http://ww. |
| 3 | Company2 | 1 | Restaurants | Yum's | Yums is.. | food | 1/7/2004 | http://ww. |
| 4 | Company1 | 1 | Restaurants | Pappas Pizza | We have. | pizza, pappas | 2/5/2005 | http://ww. |
| 5 | Company2 | 2 | Restaurants | Pizza To Go! | Go get y.. | food, takeout | 11/30/3006 | http://ww. |
| 6 | Company2 | 2 | Restaurants | Taco Place | Mmmmm.. | food, taco | 12/2/2007 | http://ww. |
| 7 | Company1 | 7 | Restaurants | Family Dining | Somethin. | food, dining | 2/5/2005 | http://ww. |
| 8 | Company3 | 12 | Restaurants | Fast Pizza | 5 mins or. | pizza, fast | 12/23/2006 | http://ww. |

Figure 3

Search Log Entries 130

| Id | Address | Keywords | Campaign ID | Category | Date | Time | Set ID | Listings | Selected |
|---|---|---|---|---|---|---|---|---|---|
| 78 | 192.168 … | NY, deli | 1 | Restaurants | 1/7/2007 | 12:45:16 | 5765 | 1, 65 … | 1 |
| 79 | 10.107 … | LA, pizza | 2 | Restaurants | 2/5/2007 | 1:55:37 | 3295 | 2, 72 … | 72, 55 |
| 80 | 172.16 … | refinance, … | 7 | Finance | 2/7/2007 | 18:12:55 | 5 | 105, 23 … | 77 |
| 81 | 192.168 … | boat loans | 12 | Finance | 2/13/2007 | 13:01:09 | 7 | 9, 19 … | , 19, 22 … |
| 82 | 10.10.37 … | LCD, tv, review | 54 | Electronics | 2/15/2007 | 6:15:22 | 22 | 97, 78 … | 97, 53 … |

Figure 4

OPTIMIZED BIDDING FOR PAY-PER-CLICK LISTINGS

CROSS-REFERENCE TO RELATED APPLICATIONS

This application claims the benefit of U.S. provisional application Ser. Nos. 60/889,874 (entitled "ADVERTISING METHOD"), 60/889,830 (entitled "OPTIMIZED BIDDING SYSTEM"), and 60/889,828 (entitled "CLICK-THROUGH RATE NORMALIZATION"), all filed Feb. 14, 2007, and all hereby incorporated by reference in their entireties. This application is also related to the following co-pending U.S. patent applications that are commonly owned with, and filed the same day as, the present application: Ser. No. 12/031,028, entitled "ORGANIZING SEARCH RESULTS;" and Ser. No. 12/031,098, entitled "CLICK-THROUGH RATE ADJUSTMENT." All of the foregoing related applications are fully incorporated herein by reference.

BACKGROUND

Applications known as "search engines" are widely available on computer networks such as intranets and the Internet, including the World Wide Web. Search engines typically enable users to locate desired content, e.g., in web sites, etc. Users indicate key words of interest, and a search engine responds with search results, and may also provide listings from advertisers. For example, pay-per-click (PPC) listings may allow an advertiser to pay a search engine advertising or listing fee only when a user selects, e.g., clicks on, the listing. The position of a PPC listing in a set of search results, e.g., second in a set of five listings, may be determined according to a bid amount, i.e., an amount that an advertiser is willing to pay upon a user selection of the listing.

From the standpoint of being selected by a user, it is generally advantageous for a listing to be placed in a higher position, e.g., first as opposed to fourth in a set of five listings, because users often follow a tendency to select listings that are placed higher. Nonetheless, regardless of where they are placed in a set of search results, some listings may be more or less likely to be selected by a user than other listings. Frequently, advertisers will specify a maximum bid amount, i.e., a maximum amount that the advertiser is willing to pay to have a listing included in a set of search results.

Increasing revenues while treating advertisers fairly remains a challenge for online advertising systems. On the one hand, an online advertising system may wish to maximize revenue and therefore display listings according to the highest maximum bid amounts of advertisers. On the other hand, the online advertiser may not wish to discourage advertisers making lower bid amounts from participating in an online advertising system. Ultimately, it would benefit an online advertising system to order listings in such a way that listings would be likely to be selected by the user.

BRIEF DESCRIPTION OF THE DRAWINGS

FIG. 3 illustrates an exemplary set of listings.

FIG. 4 illustrates an exemplary set of search log entries.

DETAILED DESCRIPTION OF THE PREFERRED EMBODIMENTS

Figure 1:
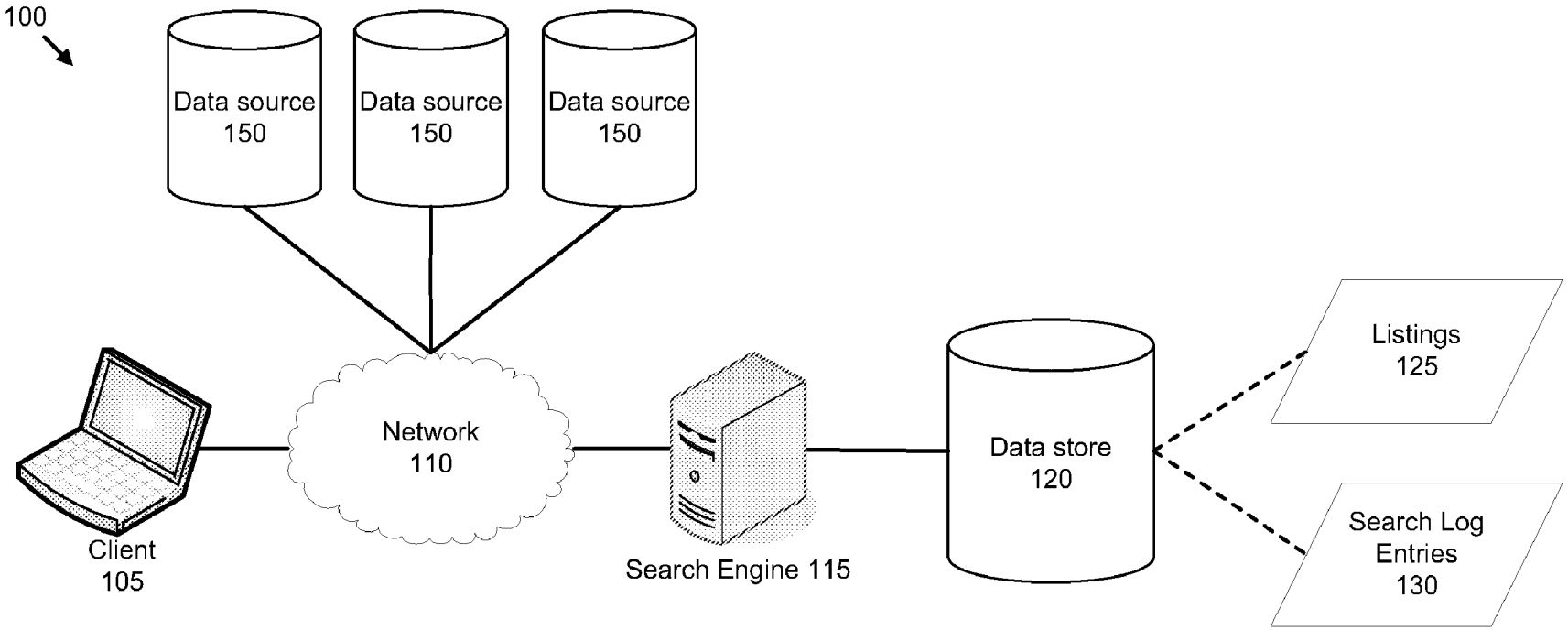
FIG. 1 illustrates an exemplary information distribution system that includes a client in selective communication with a search engine via a network.

FIG. 1 illustrates an exemplary information distribution system 100 that includes a client 105 in selective communication with a search engine 115 via a network 110. Search engine 115 also selectively communicates with a data store 120, possibly through network 110, but more likely though a local area network (LAN), or the like (not shown in FIG. 1). Although shown as included in separate computing devices in FIG. 1, search engine 115 and data store 120 may be included within a single computing device, or may each include clusters of computing devices for purposes of redundancy, processing efficiency, etc. In any event, data store 120 may include a plurality of listings 125 and a plurality of search log entries 130. It should be understood that various embodiments of system 100 may include a variety of components, information types, interactions, etc., including, but in no way limited to, those mentioned herein.

Client 105 allows a user to communicate through network 110, e.g., to interact with search engine 115. Client 105 may be any one of a number of computing devices that include one or more software applications for facilitating such communications. For example, client 105 may be a desktop computer, a laptop computer, a mainframe computer, a mini-computer, a cell phone, a personal digital assistant, or other computing device capable of communicating via a network. Also, while only one client 105 is shown in FIG. 1, many different clients 105 may submit queries and receive responses using system 100.

Network 110 may include any medium or media capable of transmitting data between client 105 and search engine 115, such as the Internet, a local area network, a wide area network, a cellular network, etc. Search engine 115 may accept a query submitted by client 105, and may in turn query data store 120. Search engine 115 may be any device or combination of devices configured to receive information from one or more clients 105, and to in turn communicate with data store 120. For example, search engine 115 may be a server computer, a query server, a web server, a search server, a mainframe, a computing cluster, or the like.

Search engine 115 may include one or more web servers, which may facilitate access to client 105. Accordingly, search engine 115 may provide client 105 with a graphical user interface (GUI) such as a web page, hypertext markup language (HTML) page, or the like. Such GUIs are typically accessible through a web browser or a client application that is included within client 105. Further, client 105 may display other kinds of user interfaces, such as a text-only interface, or any other interface capable of transmitting queries and receiving query results from search engine 115. Search engine 115 selectively communicates with data store 120.

Data store 120 may include one or more relational databases. Alternatively or additionally, data store 120 may include one or more object-oriented or hierarchical databases, or other mechanisms for storing and accessing data, including arrays, pointers, flat files, etc. As mentioned above, data store 120 may be included in a separate computing device from that hosting search engine 115, or may be a software application executing on a same computing device as search engine 115.

Figure 2:
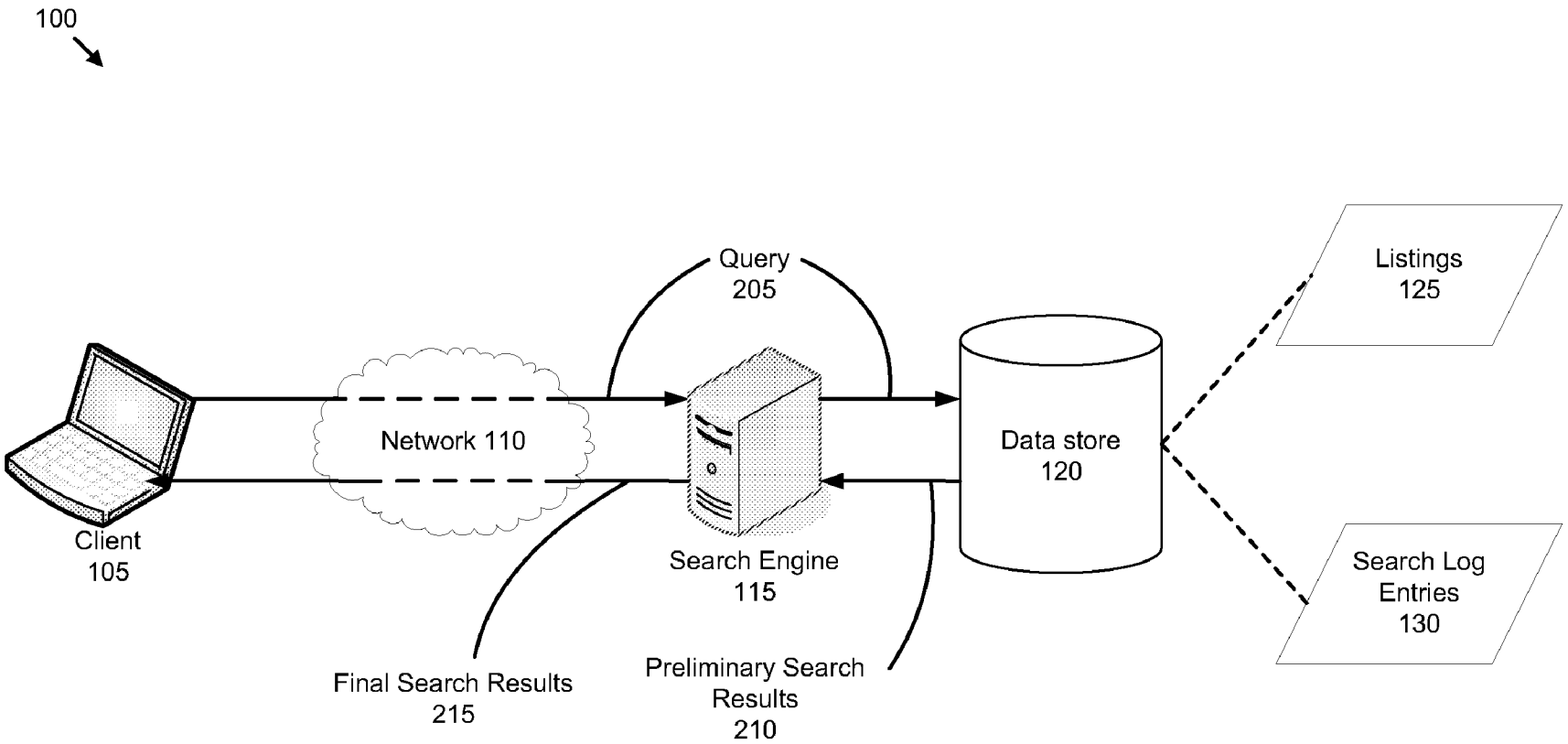
FIG. 2 illustrates an exemplary information distribution system including communication between a client and a search engine via a network.

FIG. 2 is another exemplary illustration of information distribution system 100, including an illustration of communication between client 105 and search engine 115 via network 110. As shown in FIG. 2, client 105 may submit a query 205 to search engine 115 via network 110. Search engine 115 may accept query 205 submitted by client 105, and may in turn query data store 120. Data store 120 may then return a set of preliminary search results 210 to search engine 115. Search engine 115 may then re-package, modify, and/or perform additional actions on search results 210 before responding to client 105. For example, as discussed below, search engine 115 may respond to client 105 with a set of final search results 215, which are may be substantially the same as results 210, but are generally modified, i.e., by re-ordering or otherwise affecting the display of listings 125. Search engine 115 generally attempts to provide client 105 with listings 125 in a set of final search results 215 that are both relevant to query 205, likely to be clicked on or otherwise selected by a user, account for an advertiser's bid amount, and also account for a listing's 125 performance. Search engine 115 may also provide data to data store 120 based on the provided search results 215, or a user's activity after providing such search results. For example, search engine 115 may provide data to be stored in data store 120, or more specifically, search engine 115 may provide data to be stored in search log entries 130.

Query 205 need not be received from client 105. For example, search engine 115 may receive query 205 from another computing device that transmits query 205 on behalf of client 105. In addition, search engine 115 may also provide results 215 to another computing device that may then forward results 215 to client 105. For example, client 105 may be a cellular telephone that communicates with a proxy server in a cellular network. The proxy server may communicate with search engine 115 on behalf of client 105, thereby sending and receiving information between client 105 and search engine 115. Generally, search engine 115 provides a set of search results 215 to client 105 in response to a query 205. Such search results 215 typically include one or more listings 125.

Listings 125 may be stored in data store 120, whereby listings 125 may be updated, deleted, added, accessed, etc. Individual listings 125 may be represented by one or more database records included in data store 120. Each listing 125 generally represents an entity, e.g., a business, school, church, government agency, person, product, etc. Listings 125 may include data such as information from a directory, such as yellow pages or a white pages directory, a directory of content on a network, e.g., pages available on the world wide web, etc. In addition, listings 125 may include advertising information. For example, a listing 125 may include a product advertisement and a hyperlink to a business that sells the product. Further, multiple listings 125 may represent a particular entity.

Data sources 150 typically provide data for listings 125. A data source 150 may be a website, an advertiser, a vendor, a company, a directory, or the like. A variety of known mechanisms for importing data from data sources 150 may be used to create, modify, or remove a listing 125. For example, system 100 may utilize a web crawler or spider to gather data from data sources 150. In addition, data sources 150 may provide data for listings 125 directly to search engine 115, data store 120, or some other storage mechanism. For example, data source 150 may be an advertiser that buys or bids on keywords, pays for a sponsored search result, etc. Data sources 150 may be made available by vendors, and/or listings 125 may be populated by data from computer readable media directly into data store 120, by data entry into data store 120, etc. Because data sources 150 are frequently provided by different parties, listings 125 populated from data sources 150 frequently include different listings 125 representing a single entity, e.g., a school, a church, a business, a government agency, a person, etc. Further, even when listings 125 are populated from a single data source 150, or from data sources 150 provided by a single vendor, data store 120 may include different listings 125 representing a single entity.

FIG. 3 illustrates an exemplary set of listings 125. Individual listings 125 may be represented by one or more database records included in data store 120. Each listing 125 may contain data or information relating to one or more listing attributes. For example, listings 125 may include one or more of the following fields: a listing identifier (ID), a Globally Unique Identifier (GUID), an advertiser name, a company name, a geographic region, a campaign ID, a category, a description, a keyword, a date of entry, and a hyperlink. Further for example, a listing 125 may include one or more of the following listing attributes: the identity of an advertiser who is associated with the listing125, a geographic region, one or more categories, e.g., business categories, to which the listing 125 is relevant, a description of the listing 125, text to be included in the display of the listing 125, at least one keyword that may be used to search for the listing 125, a date/time the listing 125 was added to data store 120, a hyperlink to direct a user to a particular website if the listing 125 is selected, etc.

A listing 125 may include a listing ID, an advertiser name, a bid amount, a campaign ID, and one or more fact values. A listing ID is generally an automatically generated number or code that allows search engine 115 to identify a particular listing 125. An advertiser name may be a company name, a brand name, or identify some 3$^{rd}$ party advertising agency that is advertising on behalf of a company, a brand, etc. A category generally relates to the nature or subject matter of a particular listing 125, and a listing 125 may be placed into a category with other listings 125 that include similar subject matter. For example, search engine 115 may include categories such as restaurants, banks, electronics, news, shoes, watches, discounts, directions, maps, or any other category that could be used to group several listings 125 together. Listings 125 may also include a short description, such as a headline, and/or a long description, more fully describing the advertised goods and/or services, or providing additional information about a particular website. Listings 125 may also include keywords selected by an advertiser, a data source 150, or the like. In addition, listings 125 may include a key word that is selected by search engine 115. Further, listings 125 may include a hyperlink or address that can be clicked-on or otherwise selected by a user, e.g., by hovering, right-clicking, highlighting, tabbing, etc. Listings 125 may also include additional data or information as needed or desired by search engine 115, such as a bid amount, a geographic location, a performance metric, a performance score, or the like, as discussed in more detail below.

FIG. 4 illustrates an exemplary set of search log entries 130 that may also be stored in data store 120 by one or more database records. Search log entries 130 include data about final search results 215 that are provided to a client 105 in response to a query 205, and may also include data about a user's interaction with, e.g., selection of listings 125 included in, results 215. For example, search log entries 130 may include information such as which listings 125 were included in a search result 215, a geographic region with which a search result 215 is associated, and which listings 125 in the results 215 may have been selected, e.g., clicked on. For example, search log entries 130 may include a listing identifier associated with each listing 125 that was provided to client 105 in response to a search query 205. Further, as shown in FIG. 4, search log entries 130 may also include information such as a time, a date, a client address, a geographic area associated with a client, a search category, a keyword, a control set identifier, a selection or click counter, etc. A control set identifier, or Set ID, may indicate that a particular control set was provided to client 105 in a set of search results 215. Search log entries 130 may also indicate which listings 125 were provided to client 105, and may also indicate the order in which the listings 125 were provided in the set of results 215. In addition, search log entries 130 may include a rank, or position, of a particular listing 125, whether or not the listing 125 was selected (e.g. clicked-through, highlighted, hovered over, expanded, etc.), from what geographic location or region a search query was initiated, and a time or date when a search was performed. Additionally, the rank or position of a listing 125 may be stored in search log entries 130, including a rank or position of a listing 125 when that listing 125 was clicked on or selected.

Search log entries 130 may also include location information based on a keyword included in a query 205, based on client 105, or based on some other indicator. For example, a search query 205 may include such terms as "New York" or "Detroit" that may indicate a geographic location. In addition, search engine 115 may receive additional information from client 105 that can be used to associate a geographic location with client 105. For example, search engine 115 may receive an address, such as an Internet Protocol (IP) address. Search engine 115 may also selectively communicate with a location database in order to associate a received IP address with a geographic location. For example, organizations such as the American Registry of Internet Numbers (ARIN) of Chantilly, Va., maintain registration information for IP addresses that includes a physical location. Generally, search engine 115 may utilize information in listings 125 and search log entries 130 to respond to a query 205 with listings 125 that are relevant and likely to be selected or clicked on by a user.

Using search log entries 130, search engine 115 may perform one or more calculations, such as how many times a listing 125 was displayed, and out of those times how many times a listing 125 was clicked on or otherwise selected. Thus, search log entries 130 may be used for the calculation of click-through rates, as well as other calculations based on the information stored in search log entries 130. Search log entries 130 may also include one or more previously calculated values, such as a click-through rate, an average click-through rate, a performance score, or the like, as discussed in more detail below.

As used herein, the term "impression" refers to an appearance of a listing 125 within a set of search results 215. "Impression count" refers to the number of impressions for that particular listing 125. Also as used herein, a "click," "selection", or a "click count" typically refers to the number of times an impression of a listing 125 is selected, e.g., clicked on, highlighted, hovered over for a pre-determined amount of time, expanded, etc. A "click-through rate" (CTR), which refers to a click count divided by an impression count, may be used to measure the performance of a listing 125. For example, a CTR may be defined by:

$$CTR_i = \frac{S_u}{IMP_i}$$

where $CTR_i$ represents a click-through rate of a particular listing 125 that was placed in the $i^{th}$ position in a set of search results. Typically, the particular listing of interest would be provided in the same position repeatedly in various sets of search results. $S_u$ is a "click count" of the listing, generally representing how many times a particular listing 125 was clicked on or otherwise selected, and $IMP_i$ is an "impression count" corresponding to how many times the listing 125 was provided in the $i^{th}$ position in a set of final search results 215. The click count and impression count may also be provided according to whether a listing 125 was selected by the same user or client 105, or by separate users or clients 105.

As previously discussed, a listing 125, such as a PPC listing, may appear in different positions in a set of search results 215. A listing 125 may also be placed in different positions depending on the set of search results 215, e.g., a first as opposed to a fourth position in a set of five listings 125.

Search engine 115 may be configured to optimize advertisers' bidding for listings 125, including pay-per-click listings 125, by using data stored in data store 120. Search engine 115 may increase revenue, while providing quality service to advertisers and users by providing listings 125 based on various formulas. For example, search engine 115 may provide and order listings 125 based a listing's bid amount and a performance score. Search engine 115 may weigh such factors, such as the bid amount and/or performance score, and order listings 125 in a set of search results 215 accordingly. Optimizing performance of a listing 125 performance has the benefit of increasing click-through rates for an entire online advertising system, thereby increasing revenues and/or user satisfaction.

In the following description, a listing 125 may also be referred to as an "item," a "bid item," or an advertisement. A listing 125 that has relatively good performance, that is, a high click-through rate (CTR), may subsequently be rewarded by being placed in better positions in a set of search results 215. Increasing a position of a listing 125 position in a set of search results 215 may also increase the odds that the listing 125 will be selected by a user. That is, listings 125 that are ordered or positioned in a more prominent place in search results 215, e.g. a first position, generally enjoy more selections, e.g., click-throughs. Search engine 115 may charge an advertiser a fee when a user selects or clicks on a listing 125, as in the case with pay-per-click (PPC) listings 125. Therefore, search engine 115 may generate additional revenue by moving a well-performing PPC listing 125 to a higher position in a set of search results 215.

Search engine 115 may also create incentives for advertisers to use search engine 115. For example, if a listing 125 is performing well with a high CTR, search engine 115 may reward the advertiser by moving the listing 125 to a more prominent position without charging the advertiser more money or increasing a cost associated with providing the listing. For example, a popular or well-performing listing 125 may be charged less for a higher or more prominent position in a set of search results 215 than another listing 125 that is not performing as well. That is, listings 125 associated with poor performance may incur higher fees or costs for certain positions in search results 215 than listings 125 with better performances. However, several factors including performance and a maximum bid amount associated with a listing 125 are weighed in order to order listings in a set of search results 215. Thus, search engine 115 may maximize revenue while providing fair value to advertisers, and also ensuring that a user receives relevant search results 215.

As mentioned above, system 100 is designed to increase revenue for an online advertising system, while also providing advertisers with a fair opportunity to have listings 125 included in search results 215, and to have such listings 125 included costing a relatively cost-effective manner. Accordingly, search engine 115 may adhere to various rules in various embodiments to meet these goals. For example, if a bid amount for a listing 125 is increased, and the rank or position of the listing 125 in a set of search results 215 is not increased, then a cost associated with a user clicking on the listing 125 may not be increased. Such a rule attempts to ensure that search engine 115 is not arbitrarily charging an advertiser more simply because an advertiser raised a maximum bid amount for a listing 125. Thus, advertisers are encouraged to raise maximum bid amounts without fear of simply being charged more without receiving additional value in return, e.g. by having listings 125 placed or ordered in more prominent positions in search results 215.

In some instances, search engine 115 may charge an advertiser a specific fee if a user clicks on or otherwise selects a listing 125 in a pre-determined position, e.g. the first position in a set of search results 215. If a maximum bid amount associated with a listing 125 is less than the current cost associated with clicking on listings 125 that are in that position, then the rank or position of the listing 125 will be decreased. Search engine 115 may also be configured to provide and/or order listings 125 based on one or more of the following:

- if a maximum bid and a performance metric associated with a listing 125A is superior to that of a listing 125B, then listing 125A will be placed in a more prominent position than listing 125B;
- if listing 125A's position is lower than a first position, and if a maximum bid or performance score for listing 125A increases, then the position of listing 125A will be improved or increased;
- the lowest cost for a listing 125 to keep its current position in a set of search results 215 may be changed based on the performance of the particular listing 125; and
- a listing 125 may be charged less than the highest bid associated with the listing 125 depending on the performance of the listing 125.

The following descriptions of various terms may be useful in understanding the equations that follow. Of course, the description of each term is not an exhaustive or exclusive definition, but merely an exemplary illustration that may be useful to gain a better understanding of the equations that follow.

A set of listings 125 may also be called a set of bid items, and defined by $B=\{b_1, b_2 \ldots b_i, b_n\}$. In one embodiment, each listing 125 or bid item $b_i$ contains two attributes as follows: $b_i(\text{campaignId}(b_i), \text{Maxbid}(b_i))$.

A set of Click-Throughs $CT=\{ct_1, ct_2, \ldots, ct_n\}$. In one embodiment, each click-through $ct_i$ contains certain attributes, including a bid item, a rank, and at least one fact ID: $ct_j(b_i, \text{rank}, \text{factID}_1 \ldots \text{factID}_t$.

A campaign may be understood as an advertisement, or series of advertisements, for a specific service or product that an advertiser may want to promote. Advertisers may bid for a particular position or rank based on a campaign in one or more categories, for example. Thus, a campaign may further be understood as a particular set of attributes associated with a plurality or grouping of listings 125, typically by one advertiser, but may include multiple advertisers. A campaign may include one or more of the following: a chosen location, locality, or region; a category; a timeframe; a keyword; etc. A campaign may include a plan to achieve a certain goal or to accomplish a certain purpose in relation to one or more listings 125, such as to produce a certain number of impressions, a certain number of click-throughs, increase visibility of one or more related listings 125, etc. Thus, a campaign may be planned to last for a predetermined period of time, or until one or more listings 125 are displayed in search results 215, etc.

A set of Fact values, denoted F, may affect a performance score (PS), and may also be used to order listings 125 in a set of search results 215. While the following illustrates several examples of facts or data that may be associated with listing 125, search log entry 130, or query 205, facts other than those listed below may alternatively or additionally be used.

- Relevancy Score—a measure of how well a search term in query 205 matches or relates to certain attributes of listing 125, including a campaign tile, a company name, a category, a company profile, a product offering, etc.
- Category Popularity Ranking—a statistical representation of data of a number of clicks or selections that a particular category receives, divided by a number of impressions a category of listings 125 that are also associated with that particular category.
- Locality Importance—a number representing the relative importance of a geographic region or locality based upon query 205. For example, query 205 may include search terms "NY" and "deli," which may indicate a desire to find delicatessens in New York City. In such a scenario, the relative importance of the locality of listings 125 may be high, as delis in areas outside of New York City may be completely irrelevant to query 205. On the other hand, a query 205 may include search terms "plasma" and "TV," in which case a locality or geographic area of listings 125 may be of little importance, or completely irrelevant. The locality importance may also vary depending on a category that is associated with query 205 and/or listings 125.
- Landing Page Quality Score—a measure of document similarity or relevancy between a query 205 and a campaign. For example, the first page of a website may include a plurality of links, where the majority of those links correspond to other web pages within that particular website, as opposed to directing a user to another website, and such a ratio may earn that particular first page of that website a relatively high landing page quality score.

One or more of these facts can be used on a flexible basis based on data collection and business needs. The following additional terms are used and described as follows:

- PS—Performance Score.
- CT—Click Through, i.e., number of times a user has selected, or clicked on a listing 125, e.g. a bid item $b_i$.
- CTRV—Click Through Rate Value may be defined as a number of click-throughs divided by a number of impressions, generally reflecting how frequently users are clicking on a listing 125.
- IMPRE—number of impressions of a listing 125 by a user, e.g., a viewing of an advertisement bid item.
- AVCTRV—Average Click Through Rate Value.
- RankValue—a value associated with giving a listing 125 a given position, or Rank, in a set of results 215, i.e., the value, i.e., a numerical score, of a position of an item in a set of items; the bigger the value, the higher, i.e., closer to 1, the rank will be. As discussed in more detail below, RankValue may be calculated based on a bid amount and a performance score.
- Rank—The position of a listing 125 in a set of search results 215. A lower value means a higher or more prominent rank or position in search results 215. e.g., "0" or "1" are generally the highest ranks.
- Cost—amount paid by an advertiser for a bid item upon click-through of the item.
- MaxBid—the maximum amount that an advertiser is willing to pay to have a bid item $b_i$ listed in a set of search results 215. For example, if the MaxBid of a bid item $b_i$ is \$2.50, that means that the advertiser is willing to pay a cost for the bid item $b_i$ in the range from MinCost to \$2.50 to get a best position in any search results 215.

MinCost—the minimum fee search engine 115 will charge for listing a bid item bi at a particular position in a set of search results. For example, if the minimum of bid item bi is \$0.20, then that means the advertiser is willing to pay a cost in the range from \$0.20 to MaxBid to get the best position available in any set of search results 215.

Search engine 115 may use three parameters when providing PPC listings 125 in a set of search results 215: a ranking value, a cost value, and a maximum revenue adjustment value.

Ranking Value

The purpose of the ranking value is to rank a PPC bid item within a set of items, e.g., within a set of PPC listings 125 in search results 215. Accordingly, RankValue is calculated based primarily on two components: MaxBid and Performance Score. By normalizing click-through rates, the calculation of Performance Score provides a more accurate representation of the relative performance between listings 125. In general, the manner of calculating RankValue supports optimized bidding.

A first step may be to calculate a CTRV of a bid item, listing 125. Associated with a particular bid item $b_i$ is a set of CTRVs for each Rank that the bid item $b_i$ has had: $CTRV(b_i)=\{CTRV_0(b_i), CTRV_1(b_i), \ldots, CTRV_j(b_i), \ldots, CTRV_n(b_i)\}$; $j \in D(\text{Rank})$ Accordingly, CTRV for a bid item $b_i$ at a Rank j can be calculated as follows:

$$CTRV_j(b_i) = \frac{\sum_{t=0}^{CT_j(b_i)} \left(\prod_{k=0} F_k(b_i, t)\right)}{IMPRE_j(b_i)} \quad (j \in D(\text{Rank})) \qquad \text{Equation 1}$$

Equation 1 takes into account various factors related to a Performance Score. It is to be understood that Equation 1 could also accommodate other factors.

AVCTRV, on the other hand, does not distinguish individual bid items $b_i$. $AVCTRV=\{avctrv_1, avctrv_2, \ldots, avctrv_i, \ldots, avctrv_n\}$; $i \in D(\text{Rank})$;

Equation 2 represents a formula for AVCTRV and is as follows:

$$AVCTRV_j = \frac{\sum_{t=0}^{CT_j} \left(\prod_{k=0} F_k(t)\right)}{\sum IMPRE_j} \quad (j \in D(\text{Rank})) \qquad \text{Equation 2}$$

It is now possible to calculate a Performance Score PS for a bid item $b_i$, as illustrated below in Equation 3:

$$PS(b_i) = \frac{\sum_{j=1}^{n} \frac{CTRV_j(b_i)}{AVCTRV_j}}{M} \quad (j \in D(\text{Rank})); \text{ and} \qquad \text{Equation 3}$$

$$M = \sum_{t=0}^{n} \left(IMPRE \sum t(b_i) > 0\right) \text{ or}$$

-continued $$M = \sum_{t=0}^{n} (IMPREt(b_i) > MINREQPRE)$$

In Equation 3, MINREQPRE is a predetermined number of impressions needed to have a statistically or mathematically significant number or impressions, where the number of impressions refers to how many times a listing 125 was visible to a user during a pre-determined time period of data collection.

Equation 4 for RankValue is based on PS and Maxbid, and includes two weight variables $A_1$ and $A_2$ for each of PS and MaxBid, where the determination of $A_1$ and $A_2$ are discussed in more detail below with reference to Equation 13. In general, $A_1$ and $A_2$ are weighting values that affect the relative weight or influence that Ps and Maxbid have over the RankValue determination.

$$\text{RankValue}(b_i)=(A_1*PS(b_i))+(A_2*\text{Maxbid}(b_i)) \qquad \text{Equation 4}$$

Once RankValues are calculated for a set of bid items, bid items can be ranked, or positioned in a set of search results 215, based on the RankValue set. Thus, the ranking procedure includes sorting the bid items based on RankValues. An obtain function is used to get a Rank from a set of RankValues. It will be understood that these functions may be easily implemented programmatically.

$$\text{Rank}(b_i)=\text{ORDER}(\text{SORT}(\text{RankValue}(b_i)) \qquad \text{Equation 5}$$

Once the Rank of an item $b_i$ has been determined, a cost for each item $b_i$ in the ranked list can also be determined. Assuming the performance of each item, i.e., Performance Score PS for a given item $b_i$, and MaxBid, do not change in the given time period for any item $b_i$ in the set of search results 215, a set of rules for determining a cost for each item $b_i$ in the ranked list is as follows:

Suppose we have two bid items, $b_t$ and $b_s$, and:

If i=n then $Cost_i$=\$0.01 or MINCOST;

Else $\text{Rank}(b_t)=i$; $\text{Rank}(b_s)=i+1$; $(1<=i<n-1)$ $$\text{Cost}_i(b_t) = \frac{(PS(b_s) - PS(b_t)) * A_1}{A_2} + MaxBid(b_s) + 0.01 \qquad \text{Equation 6}$$

$$\text{where } (A_1 > 0 \text{ and } A_2 > 0)$$

Consideration of two scenarios justifies the use of the above rule in Equation 6. First, suppose that $\text{MaxBid}(b_t)=\text{cost}-0.01$. Then:

$$MaxBid(b_t) = \frac{(PS(b_s) - PS(b_t)) * A_1}{A_2} + MaxBid(b_s) \qquad \text{Equation 7}$$

However, if Equation 7 is true, then:

$$(A_1*\text{PS}(b_t))+(A_2*\text{MaxBid}(b_t))=(A_1*\text{PS}(b_s))+(A_2*\text{MaxBid}(b_s)),$$

which would mean that $b_t$ and $b_s$ each have the same RankValue, which by definition they do not.

Second, we can demonstrate that the cost for listing a bid item $b_i$ is less than $\text{MaxBid}(b_i)$. Since $\text{Rank}(b_t)=i$; Rank(bs)=i+1, we have $\text{RankValue}(b_t)>\text{RankValue}(bs)$. Then, from Equation 4 we have:

$$(A_1*\text{PS}(b_t))+(A_2*\text{Maxbid}(b_t))>(A_1*\text{PS}(b_s))+(A_2*\text{Maxbid}(b_s)) \qquad \text{Equation 8}$$

From Equation 8 we have:

$$MaxBid(b_t) > \frac{(PS(b_s) - PS(b_t)) * A_1}{A_2} + MaxBid(b_s) \quad \text{Equation 9}$$

Next, we set $$\text{Cost} = \frac{(PS(b_s) - PS(b_t)) * A_1}{A_2} + MaxBid(b_s) + 0.01 \quad \text{Equation 10}$$

From Equations 8 and 9 we have $$MaxBid(b_t) > \frac{(PS(b_s) - PS(b_t)) * A_1}{A_2} + MaxBid(b_s) >= \frac{(PS(b_s) - PS(b_t)) * A_1}{A_2} + MaxBid(b_s) + 0.01 >= \text{Cost} >= MinCost$$

Hence, illustrating that 0<MINICOST<=$\text{Cost}_t(b_t)$<=Maxbid($b_t$).

Maximum Revenue Adjustment (MRA) involves adjusting the cost of each bidding item to achieve maximum revenue while adjusting costs for bid items according to their Performance Scores, i.e., to determine appropriate values for weights $A_1$ and $A_2$.

First, the following Target Function is established and illustrated in Equation 11:

$$TotalCost = IM \sum_{i=1}^{n} \text{Cost}_i * PS(b_t) * AVCTTRV_i \quad \text{Equation 11}$$

Generally, a target Function refers to the function that is to be optimized, e.g., attempting to achieve the highest value or lowest value of the function. In Equation 11, IM is a constant representing a number of impressions. IM may be omitted without affecting the final result. When an equation, such as Equation 11, is optimized, IM may be used as a constant to calculate out the value of $A_1$ and $A_2$, and since IM is an constant, it will not affect the value of $A_1$ or $A_2$. Where (Rank($b_t$)=i), an optimized model then may be determined as:

$$MaxCost = \underset{A1 \in D, A2 \in D}{\text{Max}}(TotalCost); \quad \text{Equation 12}$$

For a simple formulation, from Equation 6, we can set $A_1/A_2=\lambda$, and further we set $A_2=1$ and $A_1=\lambda$, which will not change the function of Equation 6. So we keep the correction of Target Function as shown in Equation 11.

To solve for λ, the function now turns to be a one dimensional function:

$$F(\lambda) = F\left(\underset{\lambda \in D}{\underline{MaxCost}}(TotalCost)\right); \quad \text{Equation 13}$$

That is, the problem has been changed to find a best value of λ, to get Maximum value of the Target Function. That is, it is a one-dimensional function root optimization problem. The solution of a one-dimensional function root optimization problem is known. Embodiments may use, for example, a dimensional search algorithm or a GoldenSplit method. A basic idea of such methods is to split the variable domain from one or more initial points; compare the value of the function; and recursively split the space to reach the maximum value of the function with the acceptable difference. Such methods, as are known, require an initial search point within a domain. Obtaining a correct result may then depend on the initial point chosen for recursive search. For example, one may obtain a local maximum value, but not a global maximum value. The solution to this difficulty is to split the domain into several smaller domains, and to provide more than one initial point. All searching can be done in parallel to thereby improve performance.

In certain cases, search engine 115 may require adjusting to account for certain situations to ensure that advertisers are not over charged based on accepted business expectation. For example, where there are only very few bid items available for a set of search results 215, and the MaxBid of one bid item is much higher than all of the others, there is possibility that the advertiser providing such a bid item will be overcharged. While such overcharge may be mathematically justified, it may need adjustment to make it more acceptable in the business world.

Figure 5:
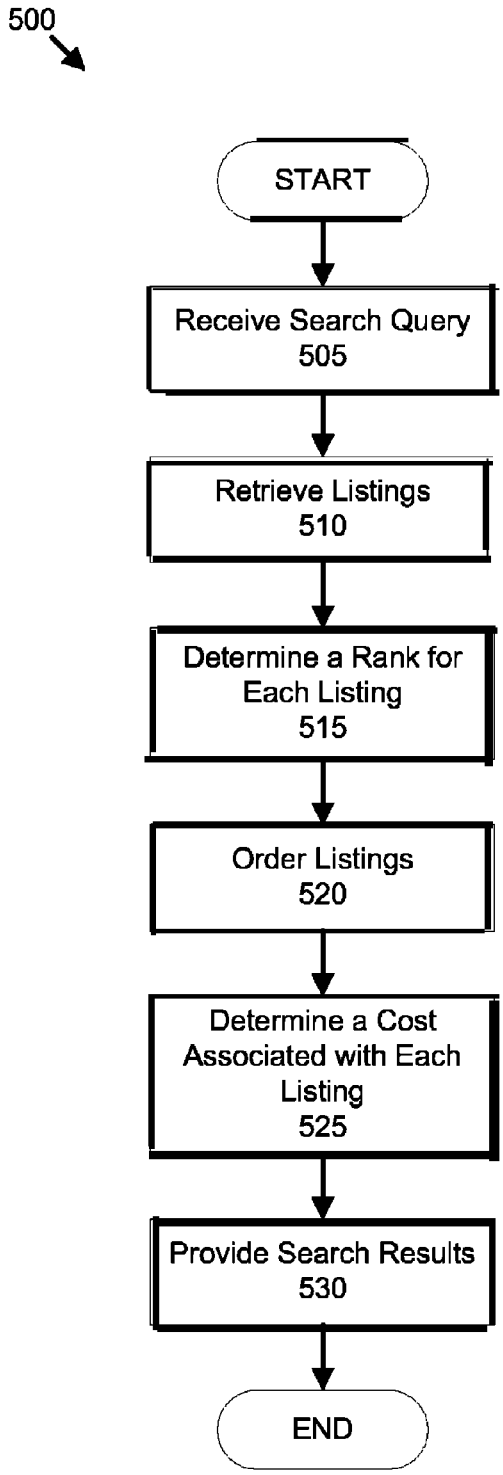
FIG. 5 illustrates an exemplary process for responding to a search query.

FIG. 5 illustrates an exemplary process 500 for responding to a search query 205. Process 500 begins in a step 505 when search engine 115 receives a search query 205. As previously discussed, a query 205 may be received from a client 105, or from some other device on behalf of client 105. Typically, a query 205 includes one or more keywords, but may also include letters, numbers, dates, times, a category, a geographic location, query language, or any additional information that search engine 115 may use to generate a response, or that might relate to one or more listings 125. In addition, a query 205 may be the result of a user selecting a hyperlink, or selecting various dimensional attributes, e.g., geographical attributes, business categories, etc. through a graphical user interface (GUI) or the like.

Next, in step 510, search engine 115 retrieves listings 125 from data store 120. Typically, search engine 115 retrieves listings based on one or more algorithms, thereby retrieving listings 125 that are relevant to the received query 205. The retrieved listings 125 typically include un-paid listings 125, as well as sponsored listings 125. Un-paid listings 125 are those that are not fee-based advertising listings 125. For example, search engine 115 may employ a spider or web crawler to search multiple data sources 150, e.g. web sites, and generate a plurality of un-paid listings 125. Sponsored listings 125, on the other hand, are typically those listings 125 that are provided by an advertiser, where an advertiser agrees to pay a fee to search engine 115 for providing the listing 125. For example, a sponsored listing 125 may be a pay-per-click listing 125, sometimes referred to as a bid item.

Next, in step 515, search engine 115 determines a RankValue associated with each listing retrieved in step 510. As previously discussed, RankValue is calculated based primarily on two components: MaxBid and Performance Score. Both a MaxBid and a Performance Score are typically determined before calculating a RankValue. Search engine 115 may periodically calculate a performance score for each listing 125, and may store the results of such calculations in data store 120, such as in listings 125, search log entries 130, or in another database. Search engine 115 may also calculate a performance score for each listing 125 retrieved in step 510 just before calculating a RankValue for each listing 125. For example, it may not be practical to pre-calculate and store performance scores for listings 125 for all different possible combinations of dimensions that could include a particular listing 125 in a response to a query 205. In any event, the RankValue may be calculated according to one or more of the formulae set forth above.

Next, in step 520, search engine 115 orders the listings 125 retrieved in step 510. Generally PPC listings 125 are ordered according to their RankValues calculated in step 515. As previously discussed, a higher RankValue merits a PPC listing 125 a higher position in the set of listings 125 retrieved in step 510 than PPC listings with lower RankValues. Further, any non-PPC listings are generally displayed after all PPC listings. Thus, listings 125 may be ordered from a most prominent, or first, position, to a least prominent, or last, position. A listing 125 in a more prominent position, such as a first position, is generally more likely to be selected than a listing 125 in a less prominent position. Search engine 115 may order the retrieved listings 125 such that a listing 125 with a higher RankValue receives a more prominent position than a listing 125 with a lower RankValue. Moreover, it is to be understood that factors other than RankValue may also be used to influence the order of listings 125.

Next, in step 525, search engine 115 determines a cost associated with each listing 125 that was ranked in step 520. As previously discussed, once the rank of a listing has been determined, a cost for each listing 125 in the ranked list can also be determined.

Next, in step 530, search engine 115 provides a set of search results 215. The set of search results 215 typically includes the retrieved listings 125 as ordered in step 520. A set of search results 215 may also include additional information, listings 125, banner advertisements, or the like.

Following step 525, process 500 ends.

Computing devices such as those used for client 105, search engine 115, data store 120, etc. may employ any of a number of computer operating systems known to those skilled in the art, including, but by no means limited to, known versions and/or varieties of the Microsoft Windows® operating system, the Unix operating system (e.g., the Solaris® operating system distributed by Sun Microsystems of Menlo Park, Calif.), the AIX UNIX operating system distributed by International Business Machines of Armonk, N.Y., and the Linux operating system. Computing devices may include any one of a number of computing devices known to those skilled in the art, including, without limitation, a computer workstation, a desktop, notebook, laptop, or handheld computer, or some other computing device known to those skilled in the art.

Computing devices such generally each include instructions executable by one or more computing devices such as those listed above. Various steps and processes disclosed herein may be embodied in whole or in part in such instructions. Computer-executable instructions may be compiled or interpreted from computer programs created using a variety of programming languages and/or technologies known to those skilled in the art, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of known computer-readable media.

A computer-readable medium includes any tangible medium that participates in providing data (e.g., instructions), which may be read by a computer. Such a medium may take many forms, including, but not limited to, non-volatile media and volatile media. Non-volatile media include, for example, optical or magnetic disks and other persistent memory. Volatile media include dynamic random access memory (DRAM), which typically constitutes a main memory. Such instructions may be transmitted by one or more transmission media, including coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Databases or data stores described herein may include various kinds of mechanisms for storing, accessing, and retrieving various kinds of data, including a hierarchical database, a set of files in a file system, an application database in a proprietary format, a relational database management system (RDBMS), etc. Each such database or data store is generally included within a computing device employing a computer operating system such as one of those mentioned above, and are accessed via a network in any one or more of a variety of manners, as is known. A file system may be accessible from a computer operating system, and may include files stored in various formats. An RDBMS generally employs the known Structured Query Language (SQL) in addition to a language for creating, storing, editing, and executing stored procedures, such as the PL/SQL language mentioned above.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

We claim:

1. A method, comprising:

retrieving a plurality of pay-per-click listings based on a search query;

calculating, for each pay-per-click listing, a rank value that is based at least in part on a performance score and a maximum bid, thereby generating a calculated rank value;

ordering the plurality of pay-per-click listings based at least in part on the calculated rank value;

determining, in a computing device having a processor and a memory, a cost associated with each of the plurality of pay-per-click listings; and calculating a performance score associated with each of the plurality of pay-per-click listings according to the formula:

$$PS(b_i) = \frac{\sum_{j=1}^{n} \frac{CTRV_j(b_i)}{AVCTRV_j}}{M} \quad (j \in D(\text{Rank}))\text{; and}$$

$$M = \sum_{t=0}^{n} \left(IMPRE \sum t(b_i) > 0\right) \text{ or}$$

$$M = \sum_{t=0}^{n} (IMPRE t(b_i) > MINREQPRE).$$

2. The method of claim 1, further comprising providing a set of final search results, the set of final search results including at least some of the plurality of pay-per-click listings for display in a client.

3. The method of claim 1, wherein the plurality of pay-per-click listings are ordered such that a pay-per-click listing with a higher rank value receives a lower rank than a pay-per-click listing with a lower rank value.

4. The method of claim 1, further comprising ordering the plurality of pay-per-click listings such that a first pay-per-click listing receives a lower rank in a set of final search results than a second pay-per-click listing if a maximum bid and a performance score associated with the first pay-per-click listing are both greater than a maximum bid and a performance score associated with the second pay-per-click listing.

5. The method of claim 1, further comprising moving a pay-per-click listing from a higher rank to a lower rank in a set of final search results if the pay-per-click listing is not at a first rank, and if a maximum bid or a performance score associated with the listing increases.

6. The method of claim 1, further comprising changing a minimum cost associated with providing a pay-per-click listing in a particular position in a set of final search results based on a performance score associated with the pay-per-click listing.

7. The method of claim 1, further comprising charging an advertiser less than a maximum bid associated with a pay-per-click listing based on a performance score associated with the pay-per-click listing.

8. The method of claim 1, further comprising ordering the plurality of pay-per-click listings based on the calculated rank value and at least one of a relevancy score, a category popularity ranking, a locality importance value, and a landing page quality score.

9. The method of claim 8, wherein the relevancy score is a measure of how well a search term in the search query relates to one or more attributes associated with a particular pay-per-click listing, wherein the attributes are one of a campaign tile, a company name, a category, a company profile, a description, and a product offering.

10. The method of claim 8, wherein the category popularity ranking is a statistical representation of a number of selections that a particular category receives, divided by a number of impressions associated with the category, the impressions provided by a plurality of listings that are associated with that particular category.

11. The method of claim 1, further comprising identifying a maximum bid amount associated with each of the plurality of pay-per-click listings.

12. A system, comprising;

a data store configured to store a plurality of pay-per-click listings and a plurality of search log entries; and a computing device having a processor and a memory that includes a search engine configured to receive a search query from a client, and to respond to the query by providing a set of final search results, wherein the search engine is further configured to calculate a rank value for each pay-per-click listing in the set of final search results, the rank value being based on a performance score and a bid amount, and wherein the search engine is further configured to order the plurality of pay-per-click listings based on the calculated rank values, and to provide at least some of the plurality of pay-per-click listings to a client; and further wherein the performance score is calculated according to the formula:

$$PS(b_i) = \frac{\sum_{j=1}^{n} \frac{CTRV_j(b_i)}{AVCTRV_j}}{M} \quad (j \in D(\text{Rank}))\text{; and}$$

$$M = \sum_{t=0}^{n} \left(IMPRE \sum t(b_i) > 0\right) \text{ or}$$

$$M = \sum_{t=0}^{n} (IMPRE t(b_i) > MINREQPRE).$$

13. The system of claim 12, wherein the search engine is further configured to order the plurality of pay-per-click listings such that a pay-per-click listing with a higher rank value receives a lower rank than a pay-per-click listing with a lower rank value.

14. The system of claim 12, wherein the search engine is further configured to order the plurality of pay-per-click listings such that a first pay-per-click listing receives a lower rank in a set of final search results than a second pay-per-click listing if a maximum bid and a performance score associated with the first pay-per-click listing are both greater than a maximum bid and a performance score associated with the second pay-per-click listing.

15. The system of claim 12, wherein the search engine is further configured to move a pay-per-click listing from a higher rank to a lower rank in a set of final search results if the pay-per-click listing is not at a first rank, and if a maximum bid or a performance score associated with the listing increases.

16. The system of claim 12, wherein the search engine is further configured to change a minimum cost associated with providing a pay-per-click listing in a particular position in a set of final search results based on a performance score associated with the pay-per-click listing.

17. The system of claim 12, wherein the search engine is further configured to charge an advertiser less than a maximum bid associated with a pay-per-click listing based on a performance score associated with the pay-per-click listing.

18. The system of claim 12, wherein the search engine is further configured to order the plurality of pay-per-click listings based on the calculated rank value and at least one of a relevancy score, a category popularity ranking, a locality importance value, and a landing page quality score.

19. A computer-readable medium tangibly embodying computer-executable instructions for:

retrieving a plurality of pay-per-click listings based on a search query;

calculating, for each pay-per-click listing, a rank value that is based at least in part on a performance score and a maximum bid, thereby generating a calculated rank value;

ordering the plurality of pay-per-click listings based at least in part on the calculated rank value; and determining, in a computing device having a processor and a memory, a cost associated with each of the plurality of pay-per-click listings;

wherein the performance score is calculated according to the formula:

$$PS(b_i) = \frac{\sum_{j=1}^{n} \frac{CTRV_j(b_i)}{AVCTRV_j}}{M} \quad (j \in D(\text{Rank}))\text{; and}$$

$$M = \sum_{t=0}^{n} \left(IMPRE \sum t(b_i) > 0\right) \text{ or}$$

$$M = \sum_{t=0}^{n} (IMPREt(b_i) > MINREQPRE).$$

* * * * *